US009617071B2

(12) United States Patent
Lorenzen

(10) Patent No.: US 9,617,071 B2
(45) Date of Patent: Apr. 11, 2017

(54) LID SENSOR AND RETROFIT SYSTEM

(71) Applicant: Sensor Solutions Corp., Steamboat Springs, CO (US)

(72) Inventor: David Lorenzen, Steamboat Springs, CO (US)

(73) Assignee: SENSOR SOLUTIONS CORP., Steamboat Springs, CO (US)

( * ) Notice: Subject to any disclaimer, the term of this patent is extended or adjusted under 35 U.S.C. 154(b) by 0 days.

(21) Appl. No.: 15/036,205

(22) PCT Filed: Jan. 27, 2015

(86) PCT No.: PCT/US2015/013014

§ 371 (c)(1),
(2) Date: May 12, 2016

(87) PCT Pub. No.: WO2015/113021

PCT Pub. Date: Jul. 30, 2015

(65) Prior Publication Data

US 2016/0288994 A1 Oct. 6, 2016

Related U.S. Application Data

(60) Provisional application No. 61/932,071, filed on Jan. 27, 2014.

(51) Int. Cl.
*G08B 21/00* (2006.01)
*B65D 90/22* (2006.01)
(Continued)

(52) U.S. Cl.
CPC ..... *B65D 90/22* (2013.01); *B65D 90/10* (2013.01); *B65D 90/48* (2013.01); *B65D 2211/00* (2013.01)

(58) Field of Classification Search
CPC ..... B65D 90/48; B65D 90/10; B65D 90/22; B65D 39/00; F17C 13/00; F17C 13/002;
(Continued)

(56) References Cited

U.S. PATENT DOCUMENTS 4,168,613 A * 9/1979 Nakagawa ..... B60T 11/22 137/576
5,006,046 A * 4/1991 Buckman ..... F04F 1/08 166/372
(Continued)

FOREIGN PATENT DOCUMENTS

JP 02-040821 A 2/1990
JP 10-248139 A 9/1998
(Continued)

OTHER PUBLICATIONS

International Search Report in international application No. PCT/US2015/013014 dated May 1, 2015.
(Continued)

*Primary Examiner* — Ryan Sherwin
(74) *Attorney, Agent, or Firm* — Oppedahl Patent Law Firm LLC

(57) ABSTRACT

A non-contact lid sensor is provided for use with an oil field thief hatch and a latch. The sensor is mounted to the latch and comprises a reed switch. The latch pin is removed and embedded with a magnet with the magnet's north-south poles parallel to the pin's length so that the magnet triggers the reed switch. The reed switch is oriented so that it is perpendicular to the lower latch pin and the face of the sensor. The magnet and reed switch are aligned so that when the lid is closed the reed switch never sees the 0 Gauss line of the magnet. When the latch is in a closed position the reed switch allows the current to pass through the sensor and
(Continued)

signal that the hatch is closed. The sensor system also allows for a Hall effect sensor to be used.

54 Claims, 6 Drawing Sheets

(51) Int. Cl.
*B65D 90/10* (2006.01)
*B65D 90/48* (2006.01)

(58) Field of Classification Search
CPC ..... F17C 13/004; F17C 13/005; F17C 13/02; F17C 13/06; F17C 1/00; F17C 3/00
See application file for complete search history.

(56) References Cited

U.S. PATENT DOCUMENTS

| | | | | |
|---|---|---|---|---|
| 6,441,610 | B2 * | 8/2002 | Graff | G01B 7/14 324/207.2 |
| 2004/0134239 | A1 | 7/2004 | Hapke | |
| 2009/0236012 | A1 * | 9/2009 | Gass | B23Q 11/0092 144/427 |

FOREIGN PATENT DOCUMENTS

| | | | |
|---|---|---|---|
| JP | 2003-284896 | A | 10/2003 |
| JP | 2005-181453 | A | 7/2005 |

OTHER PUBLICATIONS

International Preliminary Report on Patentability in international application No. PCT/US2015/013014 dated Apr. 5, 2016.

* cited by examiner

LID SENSOR AND RETROFIT SYSTEM

CROSS REFERENCE APPLICATIONS

This application claims the benefit of provisional application No. 61/932,071 filed Jan. 27, 2014 that is incorporated herein by reference for all purposes.

BACKGROUND

An oil field thief hatch is a closable hatch on an oil field tank or vessel. Thief hatches are typically used on low pressure and atmospheric tanks. The hatch allows for samples to be taken on the material inside, the volume of the tank to be measured, and for protecting the tank from over pressure and vacuum. Leaving the thief hatch open on a fuel storage tank can be very expensive. Fines vary from state to state with some fines being as much as $15,000 per hatch per date and these fines are ever increasing. Additionally, a hatch that appears closed, but is not latched will cost just as much in fines as one left fully open. It is thus desirable to provide a sensor system that can monitor the closed state of a thief hatch.

It is not easy to know if a hatch is fully latched as often these tanks are in the middle of a field and spaced far apart from one another. To check closure of the tank lid manual inspection is often necessary, which is time consuming and labor intensive, especially with hundreds of thousands of tanks in use. Other monitoring options include custom software sensing systems that tend to be extremely expensive and hard to install. It is thus desirable to provide a sensor system for monitoring thief hatches both new and existing with simple installation. It is also desirable to create a sensor system that can be retrofitted onto existing oil field tank lids with materials and procedures that can be used in the field.

SUMMARY

A non-contact lid sensor is provided for use with an oil field thief hatch and a latch. The sensor is mounted to the latch and comprises a reed switch. The latch pin is removed and embedded with a magnet with the magnet's north-south poles parallel to the pin's length so that the magnet triggers the reed switch. The reed switch is oriented so that it is perpendicular to the lower latch pin and the face of the sensor. The magnet and reed switch are aligned so that when the lid is closed the reed switch never sees the 0 Gauss line of the magnet. When the latch is in a closed position the reed switch allows the current to pass through the sensor and signal that the hatch is closed. The sensor system also allows for a Hall effect sensor to be used.

The apparatus for sensing closure of a latch to a thief hatch lid comprises a lid and a latch with an upper section being pivotally connected to the lid at a first location, and a lower section being in the shape of a claw. A pin is removably connected to the lid at a second location, where the claw of the latch engages with the pin to close the lid. A magnet is embedded in the pin and oriented with its magnetic poles parallel to the longitudinal axis of the pin. A sensor with a housing and a front face mounted within the latch such that the front face of the sensor is juxtaposed to the pin. The sensor is a reed switch positioned perpendicular to the front face of the sensor and to the longitudinal axis of the pin, and the magnet is offset with the front face of the sensor and the reed switch. The pin comprises three pieces a holder being cylindrical and having a cavity to insert a magnet. A press pin being cylindrical with knurls on one end and having a nail head where the press pin is insertable into the holder, securing the magnet, and locking the press pin and the holder together.

BRIEF DESCRIPTION OF THE DRAWINGS

The invention will be described with respect to a drawing in several figures, of which.

DETAILED DESCRIPTION OF THE DRAWINGS

Figure 1:
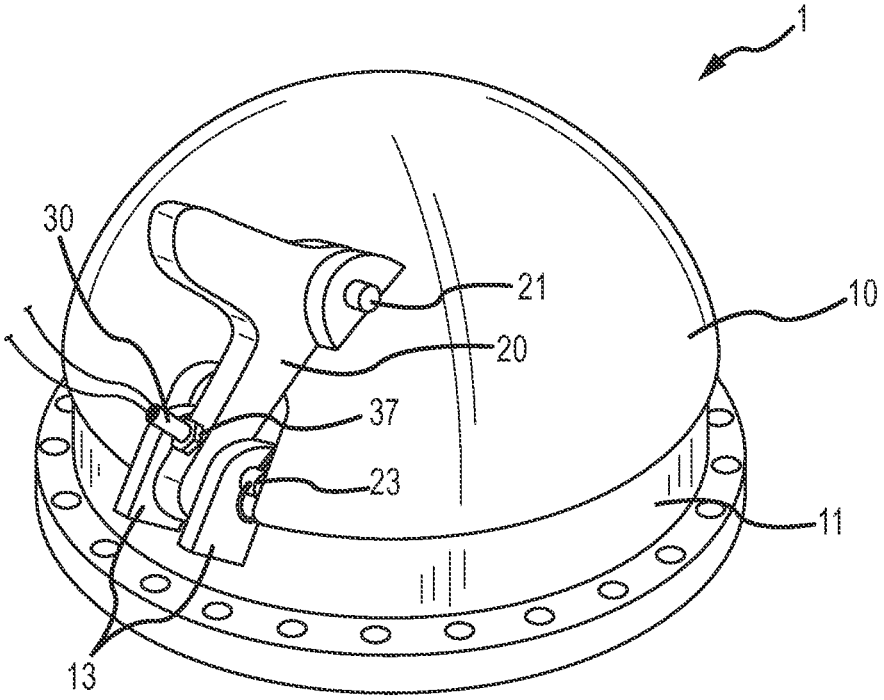
FIG. 1 shows a perspective view of the entire lid assembly and latch assembly.
Figure 2:
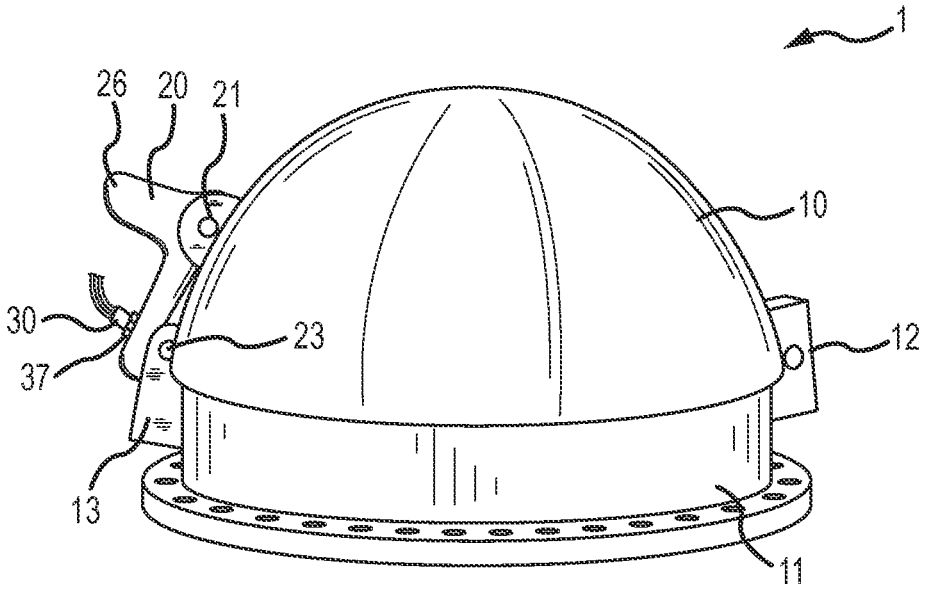
FIG. 2 shows a side view of the entire lid assembly and latch assembly.

FIG. 1 shows a perspective view of the thief hatch sensing system on an oil field tank. The overall lid assembly 1 has a lid cover 10 and a mounting collar 11, the mounting collar 11 attaches to a tank opening, not shown, and the lid assembly 1 allows access to inside the tank. On one side of the lid assembly 1 there is a hinge 12, see FIG. 2 the side view of the lid assembly 1, the hinge 12 allows the lid cover 10 to rotate about the mounting collar 11 to open the lid assembly 1 and allow access to the tank opening. On the other side of the lid assembly 1 there is a latch assembly 2 that secures the lid cover 10 in a closed position on the mounting collar 11 preventing access to the tank opening.

Figure 3:
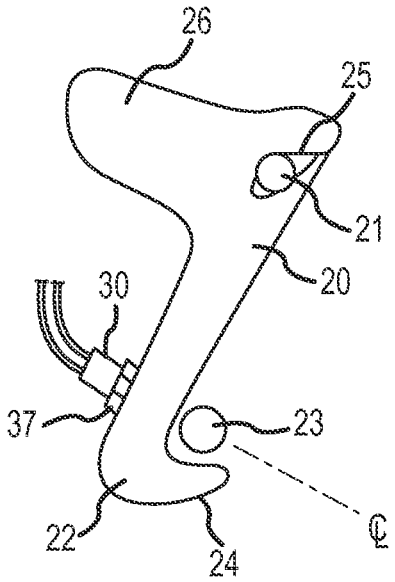
FIG. 3 shows a side detail view of the latch assembly.
Figure 4:
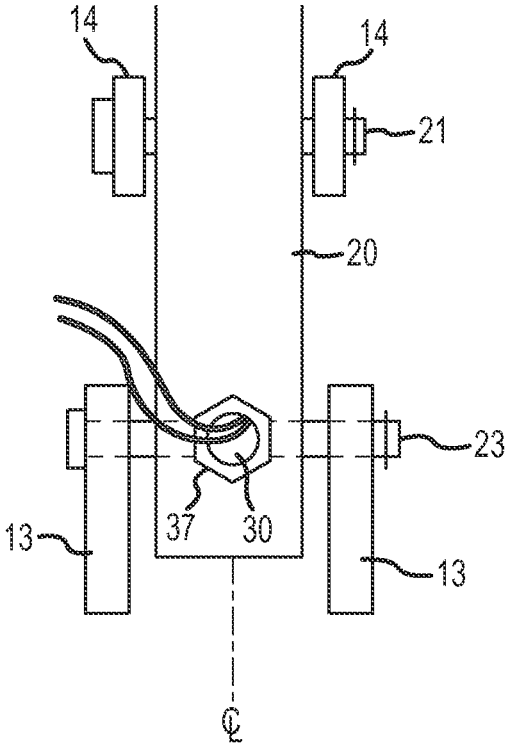
FIG. 4 shows a front detail view of the latch assembly.

The latch assembly 2, as seen in detail in FIG. 3, has a hook latch 20, the upper/top part of the latch 20 is pivotally connected to the lid cover 1 by an upper/top through pin 21. The upper pin 21 goes through openings in both the upper part of the latch 20 and a flange 14, shown in FIG. 4, protruding from the lid cover 10 allowing the latch 20 to rotate about the longitudinal center line of the upper pin 21. The lower/bottom of the latch 20 is a claw 22 that engages the lower/bottom through pin 23 to secure the lid cover 10 in a closed position. The lower pin 23 goes through two flanges 13, shown in FIG. 4, on the mounting collar 11. The two flanges 13 are spaced apart so that the claw 22 can fit between and hook around the exposed part of the lower pin 23. In the depicted embodiment, the latch 20 has a spring 25 at the upper pin 21 that urges the claw 22 toward the lower pin 23. To secure the claw 22 around the lower pin 23 the lid cover 10 is pushed down. The claw 22 has a bevel 24 that allows the claw 22 to move in an outward direction, by compressing the spring 25, around the lower pin 23 when closing the lid cover 10. After the claw 22 moves around the lower pin 23, the claw 22 positively engages the lower pin 23 to secure the latch assembly 2. To open the latch assembly 2 a user pulls up on the latch handle 25 which directs the claw 22 away from the lower pin 23 allowing the lid cover 10 to be lifted in an upwards direction and open.

It is appreciated that while FIGS. 1-4 show the preferred latch arrangement on a cast aluminum thief hatch, other lid types, latch configurations, and materials can be substituted and the depicted embodiment is not limiting.

Figure 8A:
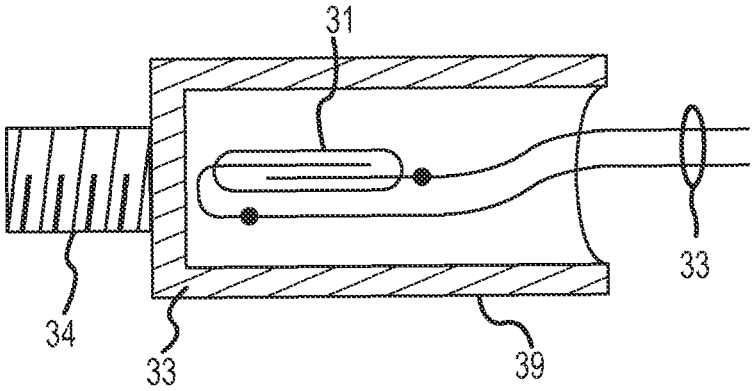
FIG. 8*a* shows a detail view of the reed switch in a second embodiment housing.
Figure 8B:
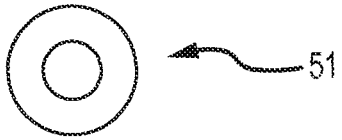
FIG. 8*b* shows a sectional view of the second embodiment housing.

Turning back to FIG. 3, a passive sensor 30 is attached to the outside face of the claw 22 located at the vertical center line or approximately close to the vertical center line of the outside face of the claw 22 and the horizontal lower pin 23 position. The sensor 30 is mounted to the latch 20 by drilling the latch 20, preferably all the way through the material, and tapping the hole allowing the sensor housing 32 to thread into the hole. In one embodiment, shown in FIG. 5, the sensor housing 32 is cylindrical in shape and secured to the latch 20 by two outside lock nuts 37, shown in FIG. 3. In an alternate embodiment, shown in FIGS. 8*a* and 8*b*, the sensor housing 38 has a front face 34 with a small threaded cylindrical section and a larger partially cylindrical section 39 with a wrench flat 51 for installation. The large partially cylindrical section 39 will force the sensor housing 38 to stop at the latch 20 at the desired mounting position and lock in place because of the torque applied to the sensor housing 38. To further secure the sensor 30 on the latch 20 a thread locking compound may also be used.

Figure 5:
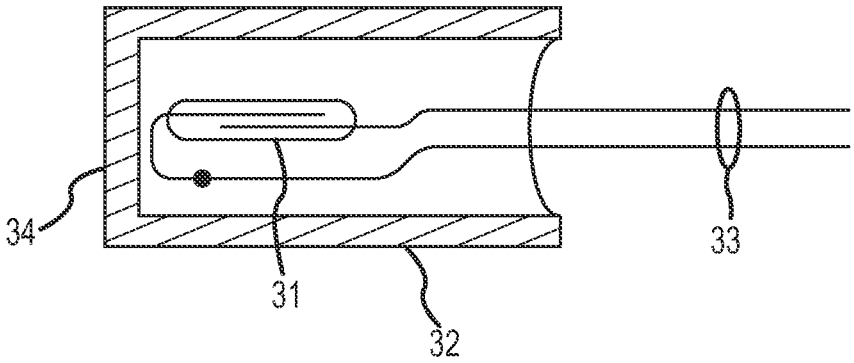
FIG. 5 shows a detail view of a reed switch in a first embodiment housing.

As shown in FIG. 5 the sensor 30 itself has a reed switch 31, a housing 32 that is threaded, a front face 34, and circuit wires 33. The sensor 30 is mounted perpendicular to the outside face of the claw 22 and with the front face 34 slightly recessed, approximately ¼ inch, from the inside face of the claw 22 to minimize the possibility of sensor damage. It is appreciated that the front face 34 may also be flush against the inside face of the claw 22 to minimize the distance from the magnet 40. In the depicted embodiments, the sensor housings 32, 38 and locking nuts 37 are 300 series stainless steel to allow a magnetic field to pass through the housing and reach the reed switch, however, it is recognized that these assembly parts may be made of other materials as well. If the housing assembly is aluminum then the assembly may be anodized to help protect from oxidization of the aluminum-aluminum bond with the aluminum latch.

The reed switch 31 is a typical reed switch known in the art that is actuated by an applied magnetic field. The reed switch 31 contains a pair or more of magnetizable, flexible metal reeds whose ends portions are separated by a small gap in a hermetically sealed environment. When a magnetic field is applied to the reeds, the reeds will move together complete the electrical circuit. When the magnetic field is removed the reeds separate and open the circuit. In the exemplary embodiment a reed switch is used because of its sensitivity and protection from atmospheric corrosion. Additionally, the switch being hermetically sealed makes it suitable for use around combustible liquids, such as oil, where sparks would constitute a hazard. The reed switch 31 is attached to a printed circuit board (PCB) that mechanically supports and electrically connects the reed switch 31 with conductive tracks etched from copper sheets laminated on a non-conductive substrate.

In the depicted embodiment, the reed switch 31 is mounted perpendicular to the front face 34 within the housing 32. This mounting forces the reed switch 31 to also be perpendicular to the outside face of the claw 22 and perpendicular to the longitudinal axis 41 of the lower pin 23.

Figure 6A:
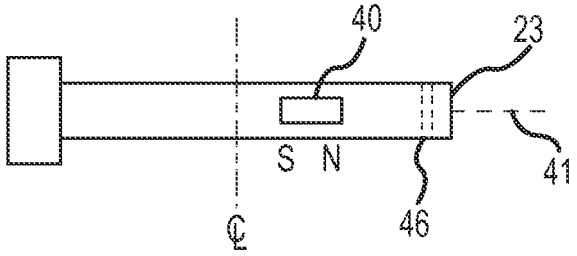
FIG. 6*a* shows a detail view of the lower pin.
Figure 6B:
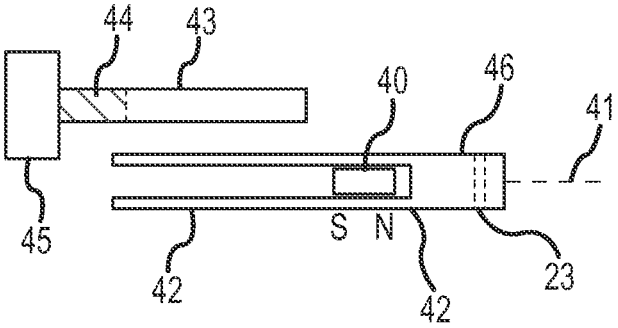
FIG. 6*b* shows an exploded view of the lower pin assembly.

In order to trigger the reed switch 31 a magnet 40 is inserted into the cylindrical shaft of the lower pin 23, as shown in FIG. 6*a*. The north-south poles of the magnet 40 are orientated along the longitudinal axis 41 of the lower pin 23. In the depicted embodiment the magnet 40 is pressed or potted into a replacement lower pin 23, and the magnet 40 is a rare-earth magnet such as neodymium-iron-boron or samarium-cobalt. As shown in FIG. 6*b*, the replacement lower pin 23 consists of three parts: a holder 42, a magnet 40, and a press pin 43. The holder 42 is drilled so that the magnet 40, with the north-south poles oriented along the longitudinal axis 41, fits within the holder 42. The press pin 43 has knurls 44 and a pin head 45 so that the press pin 43 fits within the holder 42, securing the magnet 40 inside and locking to the holder 42 by the knurls 44. It is preferable to have the holder 42 with the smallest tolerance hole so that pin head 45 of the press pin 43 will always have a small gap to the holder 42 and the magnet 40 is always held tight. However, it is recognized that the holder 42 may be drilled with a larger tolerance hole so that the pin head 45 of the press pin 43 is flush with the holder 40. Locking compound is also applied to the knurls 44 so that the press pin 43 and holder 42 connection is secured and the press pin 43 and holder 42 are kept together as one unit. The holder 42 has a hole 46 through the pin diameter to keep the assembled pin in place on the flanges 13 of the thief hatch with a cotter pin, not shown. In the depicted embodiment both the holder 42 and press pin 43 are manufactured out of aluminum, although other similar materials, such as 300 series stainless steel that allow magnetic fields to pass, may also be used.

It is recognized that the existing lower pin 23 may also be removed and drilled to embed a magnet 40 in the pin. Additionally, a new pin may be manufactured with magnetic material dispersed throughout the pin alloy providing a magnetic field in the pin. The magnet 40 may also be made of a conventional ferromagnetic material such as iron, nickel, or cobalt.

As shown in FIG. 6 the magnet 40 is inserted more than ½ of the way down the lower pin 23 so that the south pole of the magnet 40 is pointed to the center of the pin. It must be considered that the magnet 40 may be mounted in other locations and directions on the lower pin 23. In order to increase the shear strength of the pin the magnet 40 may be inserted less than ½ of the way down the lower pin 23. This described pin setup may also reduce the manufacturing cost of the three-part pin assembly. A reed switch is closed when one pole is present on one of the reed leads, and the other pole is present on the other lead. A reed switch is also closed if one pole is present on one bent lead as shown in FIG. 5. However, if the reed switch lines up with the zero Gauss point of the magnet, the switch will not close. This means that the only location the magnet 40 cannot be located on the lower pin 23 is when the zero Gauss point is in line with the reed switch 31. Therefore, the magnet 40 is preferably offset from the mounting point of the sensor 30, on the outside face of the latch 20.

The position of the reed switch as shown in FIG. 5 has advantages for installation. With the reed switch 31 oriented perpendicular to the front face 34, overall rotational orientation of the sensor 30, turning of the sensor 30 within the threaded mounting hole, does not matter when mounting on the outside face of the latch 20. Additionally, with the magnet 40 oriented with the poles parallel to the lower pin's 23 length, overall rotational orientation of the lower pin 23, turning of the pin 23 within the two flanges 13, also does not matter.

The general method for sensing closure of a thief hatch lid comprises mounting the sensor 30, with a housing 32 and a front face 34. in the latch 20 by drilling a hole in the latch 20, tapping the hole, and threading the sensor 30 in the hole. Inserting a pin 23 into the lid with a magnet 40 embedded within and with the magnet's magnetic poles parallel to the longitudinal axis 41 of the pin 23. The sensor 30 is a reed switch 31 and is positioned perpendicular to the front face 34 of the sensor 30 and the longitudinal axis 41 of the pin. The magnet 40 has its 0 Gauss line of the magnetic field is offset from the front face 34 of the sensor 40 and the reed switch 31. The pin 23 comprises three parts: a holder 42, a magnet 40, and a press-pin 43. The magnet 40 is inserted into the holder 42 and secured with the press-pin 43 so as to create one pin unit. Positioning the sensor 30 within the latch 20 so that the front face 34 of the sensor is juxtaposed to the pin 23. The lid is closed and the latch 20 is engaged to the pin 23.

Figure 9:
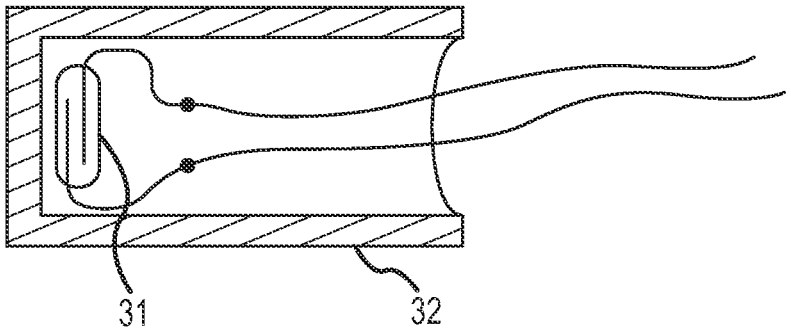
FIG. 9 shows a detail view of an alternate position of the reed switch.

As shown in FIG. 9, the reed switch 31 may also be oriented parallel to the front face 34 in the sensor 30. In this embodiment, rotational orientation of the reed switch 31 matters, and the reed switch 31 would have to be parallel to the magnet 40 to trigger the switch. If the reed switch 31 is perpendicular to the magnet 40 at the zero Gauss point the reed switch 31 would not work. Therefore, rotational orientation of the reed switch 31, and thus the sensor 30, when mounting on the outside face of the latch and the orientation would have to be closely controlled and monitored. However, this embodiment would allow the magnet 40 to be installed in the center of the lower pin 23.

Figure 10:
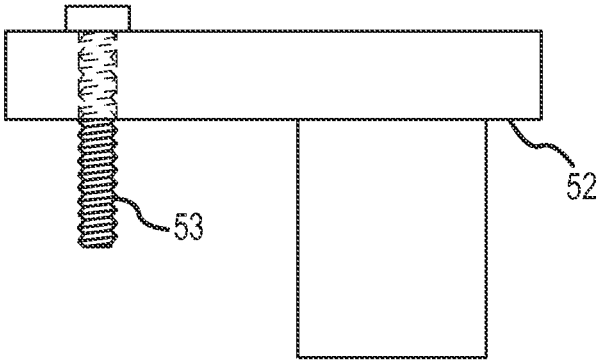
FIG. 10 shows a detail view of the flange mount.

To mount the sensor 30, with the reed switch 31 mounted parallel to the front face 34, on the latch 20, as shown in FIG. 9, a main hole on the latch 20 is drilled. A second hole adjacent to the main hole is also drilled and tapped. As shown in FIG. 10, a flange mount 52 is inserted into the main hole on the latch 20 and secured by a screw 53 in the second hole. It is preferable to secure the flange mount 52 with the screw 53 perpendicular to the reed switch 31. The flange mount 52 allows the sensor 30 to be inserted, but only in a way that the reed switch 31 inside the sensor 30 is parallel to the north-south poles of the magnet 40 and parallel to the longitudinal axis 41 of the lower pin 23. This restriction in the sensor 30 rotation allows the magnet 40 to trigger the reed switch 31. In the depicted embodiment the flange mount 52 is zinc, however other material may be used such as plastic, stainless steel, or aluminum that allows for a magnetic field to pass.

The general method for sensing closure of a thief hatch lid using a flange mount comprises mounting a flange mount 52 by drilling a main hole in the latch 20, drilling a second hole in the latch 20 adjacent to the main hole, tapping the second hole, and mounting the flange mount 52 to the latch 20 in the main hole and securing with a screw 53 in the second hole. Inserting the sensor 30, with a housing 32 and a front face 34, in the flange mount. Inserting a magnetized pin 23 in the lid and positioning the sensor 30 within the latch 20 so that the front face 34 of the sensor is juxtaposed to the pin 23. The lid is closed and the latch 20 is engaged to the pin 23.

In the depicted embodiment the sensor 30 is connected by wires 33 to a Class 1/Division 1 (C1/D1) rated wireless transmitter, not shown. Once the sensor 30 is installed and connected to the transmitter, the switch will only allow current to pass through the sensor when the hatch is closed and properly latched. As the sensor neither draws nor generates power, it can be qualified as a simple apparatus when installed behind a certified wireless transmitter. It must be appreciated that the sensor may also be attached to a non-wireless system to signal when the hatch is closed and properly latched.

Figure 7:
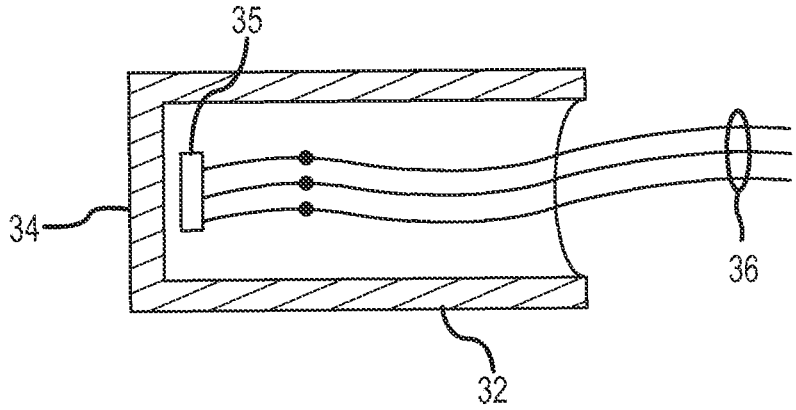
FIG. 7 shows a detail view of a Hall effect sensor.

FIG. 7 shows the sensor 30 in an alternative embodiment using a Hall effect sensor 35. The Hall effect sensor 35 is a typical Hall effect sensor known in the art that changes the digital output state with the presence of a magnetic field. The Hall effect sensor 35 is mounted in the sensor housing 32 and circuit wires 36 that send the open/closed switch signal to a transmitter. The Hall effect sensor 35 has its face parallel to the front face 34. The Hall effect sensor 35 can close when the magnet 40 in the lower pin 23 is offset from the sensor 30 mounting position. However, the Hall effect sensor 35 would not trigger if the zero Gauss point of the magnet 40 is in line with the Hall effect sensor 35. Therefore, switching the type of switch in the sensor 30 is easy and the magnet 40 position on the lower pin 23 would not need to be changed. If the south pole of the magnet 40 is facing the center line of the sensor 30 then the Hall effect sensor 35 would be south pole sensitive. Although it is recognized that depending on the location of the magnet 40 the Hall effect sensor could also be north pole sensitive, or both pole sensitive.

I claim:

1. A method for sensing closure of a latch to a hatch lid, the method comprising:

mounting a sensor in the latch, the sensor having a housing and a front face;

inserting a pin in the lid, the pin containing a magnet having a magnetization and wherein the magnet is oriented with its poles parallel to a longitudinal axis of the pin;

wherein the sensor is positioned within the latch such that the front face of the sensor is juxtaposed to the pin;

closing the lid;

engaging the latch to the pin, whereby proximity of the sensor to the magnet indicates closure of the hatch lid, and communicating closure of the hatch lid by the sensor.

2. The method according to claim 1 wherein the sensor is a reed switch, the reed switch positioned perpendicular to the front face of the sensor and to the longitudinal axis of the pin, and wherein a 0 Gauss line of a magnetic field of the magnet is offset from the front face of the sensor and the reed switch.

3. The method according to claim 2 wherein the step of inserting the pin in the lid further comprises:

inserting the magnet into a holder;

securing the magnet into the holder with a press-pin;

locking the press-pin and the holder together as one unit; and wherein the pin comprises three parts, the holder, the magnet, and the press-pin.

4. The method according to claim 3 wherein the sensor has external threads, and wherein the step of mounting the sensor further comprises:

drilling a hole in the latch;

tapping the hole; and threading the sensor into the hole.

5. The method according to claim 4 wherein the step of mounting the sensor further comprises applying thread lock compound to the sensor threads.

6. The method according to claim 5 wherein the front face is recessed within the hole in the latch.

7. The method according to claim 6 wherein the magnet is a rare-earth neodymium-iron-boron magnet.

8. The method according to claim 1 wherein the sensor is a Hall effect sensor, the Hall effect sensor positioned parallel to the front face of the sensor and to the longitudinal axis of the pin, and wherein a 0 Gauss line of a magnetic field of the magnet is offset from the front face of the sensor and the Hall effect sensor.

9. The method according to claim 1 wherein the step of inserting a pin in the lid further comprises:

removing an existing pin from the lid;
drilling an opening in the pin;
embedding a magnet in the pin;
replacing the pin in the lid.

10. The method according to claim 1, further comprising:
communicating a status of the sensor to a printed circuit board, whereby the status of the sensor is communicated to a wireless transmitter;
broadcasting the status of the sensor from the wireless transmitter to a remote location.

11. A method for sensing closure of a latch to a hatch lid, the method comprising:
mounting a flange mount to the latch, the flange mount comprising:
a sensor, the sensor having a front face;
inserting a pin in the lid, the pin containing a magnet having a magnetization and wherein the magnet is oriented with its poles parallel to a longitudinal axis of the pin;
wherein the sensor is positioned within the latch such that the front face of the sensor is juxtaposed to the pin;
closing the lid;
engaging the latch to the pin, whereby proximity of the sensor to the magnet indicates closure of the hatch lid, and
communicating closure of the hatch lid by the sensor.

12. The method according to claim 11 wherein the sensor is a reed switch, the reed switch positioned parallel to the front face of the sensor and to the longitudinal axis of the pin, and wherein the magnet is in line with the front face of the sensor.

13. The method according to claim 12 wherein the step of mounting the flange mount further comprises:
drilling a main hole in the latch;
drilling a second hole in the latch, adjacent to the main hole;
tapping the second hole; and
mounting the flange mount to the latch in the main hole and securing the flange mount by a screw in the second hole.

14. The method according to claim 13 wherein the step of inserting the pin in the lid further comprises:
inserting the magnet into a holder;
securing the magnet into the holder with a press-pin;
locking the press-pin and the holder together as one unit; and
wherein the pin comprises three parts, the holder, the magnet, and the press-pin.

15. The method according to claim 14 wherein the magnet is a rare-earth neodymium-iron-boron magnet.

16. An apparatus for sensing closure of a latch to a hatch lid comprising:
a lid;
a latch, the latch having an upper section being pivotally connected to the lid at a first location, and the latch having a lower section being in the shape of a claw;
a pin removably connected to the lid at a second location, wherein the claw of the latch engages with the pin to close the lid;
a magnet having magnetization and being embedded in the pin, wherein the magnet is oriented with its magnetic poles parallel to a longitudinal axis of the pin; and
a sensor, the sensor having a housing and a front face; wherein the sensor is mounted within the latch such that the front face of the sensor is juxtaposed to the pin.

17. The apparatus according to claim 16 wherein the sensor is a reed switch, the reed switch positioned perpendicular to the front face of the sensor and to the longitudinal axis of the pin, and wherein a 0 Gauss line of a magnetic field of the magnet is offset with the front face of the sensor and the reed switch.

18. The apparatus according to claim 17 wherein the pin further comprises:
a holder, the holder being cylindrical and having a cavity to insert the magnet;
a press pin, the press pin being cylindrical with knurls on one end and having a nail head;
wherein the press pin is insertable into the holder, securing the magnet, and locking the press pin and the holder together.

19. The apparatus according to claim 17 wherein the sensor is a reed switch, the reed switch positioned parallel to the front face of the sensor and to the longitudinal axis of the pin, and wherein the magnet is in line with the front face of the sensor.

20. The apparatus according to claim 19 wherein the sensor is connected to a flange mount on the latch, the flange mount restricting orientation of the sensor so that the reed switch is parallel to the longitudinal axis of the pin and the poles of the magnet.

21. The apparatus according to claim 16 wherein the sensor is a Hall effect sensor, the Hall effect sensor positioned parallel to the front face of the sensor and to the longitudinal axis of the pin, and wherein a 0 Gauss line of a magnetic field of the magnet is offset from the front face of the sensor and the Hall effect sensor.

22. The apparatus according to claim 21 wherein the sensor further comprises:
a threaded housing, wherein the sensor is threaded into a tapped hole in the latch and tightened.

23. The apparatus according to claim 22 wherein the sensor is further mounted to the latch with thread lock compound.

24. The apparatus according to claim 23 wherein the front face is recessed within the hole in the latch.

25. The apparatus according to claim 24 wherein the magnet is a rare-earth neodymium-iron-boron magnet.

26. The apparatus according to claim 25 wherein the sensor further comprises a wireless transmitter.

27. The apparatus according to claim 16, further comprising:
a wireless transmitter;
a printed circuit board, wherein the printed circuit board receives a signal indicating a status of the sensor and communicates the status of the sensor to the wireless transmitter; and
wherein the wireless transmitter broadcasts the status of the sensor to a remote location.

28. A method for sensing closure of a latch to a hatch lid, the method comprising:
mounting a sensor in the latch, the sensor having a housing and a front face;
inserting a pin in the lid, the pin containing a magnet having a magnetization and wherein the magnet is oriented with its poles parallel to a longitudinal axis of the pin;
wherein the sensor is positioned within the latch such that the front face of the sensor is juxtaposed to the pin offset from the midpoint between the poles of the magnet and substantially perpendicular to one pole of the magnet;
closing the lid;

engaging the latch to the pin, whereby proximity of the sensor to the magnet indicates closure of the hatch lid, and communicating closure of the hatch lid by the sensor.

29. The method according to claim 28 wherein the sensor is a reed switch, the reed switch positioned perpendicular to the front face of the sensor and to the longitudinal axis of the pin, and wherein a 0 Gauss line of a magnetic field of the magnet is offset from the front face of the sensor and the reed switch.

30. The method according to claim 29 wherein the step of inserting the pin in the lid further comprises:

inserting the magnet into a holder;

securing the magnet into the holder with a press-pin;

locking the press-pin and the holder together as one unit; and wherein the pin comprises three parts, the holder, the magnet, and the press-pin.

31. The method according to claim 30 wherein the sensor has external threads, and wherein the step of mounting the sensor further comprises:

drilling a hole in the latch;

tapping the hole; and threading the sensor into the hole.

32. The method according to claim 31 wherein the step of mounting the sensor further comprises applying thread lock compound to the sensor threads.

33. The method according to claim 32 wherein the front face is recessed within the hole in the latch.

34. The method according to claim 33 wherein the magnet is a rare-earth neodymium-iron-boron magnet.

35. The method according to claim 28 wherein the sensor is a Hall effect sensor, the Hall effect sensor positioned parallel to the front face of the sensor and to the longitudinal axis of the pin, and wherein a 0 Gauss line of a magnetic field of the magnet is offset from the front face of the sensor and the Hall effect sensor.

36. The method according to claim 28 wherein the step of inserting a pin in the lid further comprises:

removing an existing pin from the lid;

drilling an opening in the pin;

embedding a magnet in the pin;

replacing the pin in the lid.

37. The method according to claim 28, further comprising:

communicating a status of the sensor to a printed circuit board, whereby the status of the sensor is communicated to a wireless transmitter;

broadcasting the status of the sensor from the wireless transmitter to a remote location.

38. A method for use with a latch and a hatch lid lacking any electrical mechanism for sensing closure of the latch to the hatch lid, the method comprising:

mounting a flange mount to the latch, the flange mount comprising:

a sensor, the sensor having a front face;

removing an existing pin from the lid;

inserting a new pin in the lid, the new pin containing a magnet having a magnetization and wherein the magnet is oriented with its poles parallel to a longitudinal axis of the new pin;

wherein the sensor is positioned within the latch such that the front face of the sensor is juxtaposed to the new pin midway between the poles of the magnet and substantially parallel to the magnet;

closing the lid;

engaging the latch to the pin, whereby proximity of the sensor to the magnet indicates closure of the hatch lid, and communicating closure of the hatch lid by the sensor.

39. The method according to claim 38 wherein the sensor is a reed switch, the reed switch positioned parallel to the front face of the sensor and to the longitudinal axis of the pin, and wherein the magnet is in line with the front face of the sensor.

40. The method according to claim 39 wherein the step of mounting the flange mount further comprises:

drilling a main hole in the latch;

drilling a second hole in the latch, adjacent to the main hole;

tapping the second hole; and mounting the flange mount to the latch in the main hole and securing the flange mount by a screw in the second hole.

41. The method according to claim 40 wherein the step of inserting the pin in the lid further comprises:

inserting the magnet into a holder;

securing the magnet into the holder with a press-pin;

locking the press-pin and the holder together as one unit; and wherein the pin comprises three parts, the holder, the magnet, and the press-pin.

42. The method according to claim 41 wherein the magnet is a rare-earth neodymium-iron-boron magnet.

43. An apparatus for sensing closure of a latch to a hatch lid comprising:

a lid;

a latch, the latch having an upper section being pivotally connected to the lid at a first location, and the latch having a lower section being in the shape of a claw;

a pin removably connected to the lid at a second location, wherein the claw of the latch engages with the pin to close the lid;

a magnet having magnetization and being embedded in the pin, wherein the magnet is oriented with its magnetic poles parallel to a longitudinal axis of the pin; and a sensor, the sensor having a housing and a front face; wherein the sensor is mounted within the latch such that the front face of the sensor is juxtaposed to the pin offset from the midpoint between the poles of the magnet and substantially perpendicular to one pole of the magnet.

44. The apparatus according to claim 43 wherein the sensor is a reed switch, the reed switch positioned perpendicular to the front face of the sensor and to the longitudinal axis of the pin, and wherein a 0 Gauss line of a magnetic field of the magnet is offset with the front face of the sensor and the reed switch.

45. The apparatus according to claim 44 wherein the pin further comprises:

a holder, the holder being cylindrical and having a cavity to insert the magnet;

a press pin, the press pin being cylindrical with knurls on one end and having a nail head;

wherein the press pin is insertable into the holder, securing the magnet, and locking the press pin and the holder together.

46. The apparatus according to claim 44 wherein the sensor is a reed switch, the reed switch positioned parallel to the front face of the sensor and to the longitudinal axis of the pin, and wherein the magnet is in line with the front face of the sensor.

47. The apparatus according to claim 46 wherein the sensor is connected to a flange mount on the latch, the flange mount restricting orientation of the sensor so that the reed switch is parallel to the longitudinal axis of the pin and the poles of the magnet.

48. The apparatus according to claim 43 wherein the sensor is a Hall effect sensor, the Hall effect sensor positioned parallel to the front face of the sensor and to the longitudinal axis of the pin, and wherein a 0 Gauss line of a magnetic field of the magnet is offset from the front face of the sensor and the Hall effect sensor.

49. The apparatus according to claim 48 wherein the sensor further comprises:

a threaded housing, wherein the sensor is threaded into a tapped hole in the latch and tightened.

50. The apparatus according to claim 49 wherein the sensor is further mounted to the latch with thread lock compound.

51. The apparatus according to claim 20 wherein the front face is recessed within the hole in the latch.

52. The apparatus according to claim 21 wherein the magnet is a rare-earth neodymium-iron-boron magnet.

53. The apparatus according to claim 22 wherein the sensor further comprises a wireless transmitter.

54. The apparatus according to claim 43, further comprising:

a wireless transmitter;

a printed circuit board, wherein the printed circuit board receives a signal indicating a status of the sensor and communicates the status of the sensor to the wireless transmitter; and wherein the wireless transmitter broadcasts the status of the sensor to a remote location.

* * * * *